US005503215A

United States Patent [19]

Betz et al.

[11] Patent Number: 5,503,215

[45] Date of Patent: Apr. 2, 1996

[54] PRECISION CASTING SYSTEM WITH LOCK

[75] Inventors: Ulrich Betz, Hasselroth; Alfred Henn, Rodenbach; Franz Hugo, Aschaffenburg; Wolfgang Reuter, Niddatal, all of Germany

[73] Assignee: Leybold Durferrit GmbH, Cologne, Germany

[21] Appl. No.: 435,650

[22] Filed: May 5, 1995

[30] Foreign Application Priority Data

May 5, 1994 [DE] Germany ..... 44 15 855.6

[51] Int. Cl.[6] ..... B22D 18/06; B22D 37/54; B22D 27/00

[52] U.S. Cl. ..... 164/258; 164/256; 164/338.1; 164/122.1

[58] Field of Search ..... 164/256, 257, 164/258, 259, 338.1, 122.1, 122.2; 266/211, 208, 207, 143, 206, 217, 276

[56] References Cited

U.S. PATENT DOCUMENTS

| | | | |
|---|---|---|---|
| 3,554,268 | 1/1971 | Taylor et al. | 164/65 |
| 3,847,203 | 11/1974 | Northwood | 164/60 |
| 4,590,983 | 5/1986 | Reuter et al. | 164/258 |

FOREIGN PATENT DOCUMENTS

| | | |
|---|---|---|
| 1060557 | 7/1959 | Germany . |
| 3220774 | 12/1983 | Germany . |

*Primary Examiner*—Kurt Rowan
*Assistant Examiner*—I.-H. Lin
*Attorney, Agent, or Firm*—Felfe & Lynch

[57] ABSTRACT

A furnace chamber (2) has a lock (14) provided with two sealing plates (18, 22), a melting furnace (3), and a casting mold carrier (25), which can be moved horizontally through the lock (14) in the horizontal direction into a casting position (34) in the furnace chamber. An outer sealing plate (22) is mounted on a first truck (21), carrying a first rail segment (23) for a second truck (24) on the other side of the sealing plate (22), the casting mold carrier (25) being mounted on this second truck. A horizontal drive (27) is used to move the second truck (24) with respect to the first (21), and in the interior of the furnace chamber (2) there is a second rail segment (32) to which the casting mold carrier (25) is transferred from the first rail segment (23). A heating chamber (8) can be raised and lowered above the casting position (34) in the furnace chamber, which is equipped with a filling hole (12) and with heating elements (35, 36, 37). The heating chamber can be lowered over the casting mold (26) and the casting mold carrier (25).

13 Claims, 4 Drawing Sheets

PRECISION CASTING SYSTEM WITH LOCK

BACKGROUND OF THE INVENTION

The invention pertains to a precision casting system with a gas-tight furnace chamber with a lock provided with two sealing plates; with a melting furnace inside the furnace chamber; and with a casting mold carrier, which can be driven into the furnace chamber through the lock in the horizontal direction into a casting position.

In the majority of cases, precision casting systems have a vertically movable casting mold carrier, which can be driven into the casting position by means of a vertically oriented hydraulic cylinder or a threaded spindle. Because of the additive effect of the construction height and the travelling distances, this so-called vertical drive leads to an extremely tall system. As a result, the vertical drive is usually installed in a pit underneath the furnace chamber. This leads to relatively high construction and operating costs, because the vertical drive is poorly accessible to maintenance personnel. .A precision casting system of this type is known from DE-OS 32, 20, 744.

Insofar as a precision casting system of this type is equipped with a heating chamber for "oriented solidification", the casting mold is lowered out of the heating chamber by the creeping motion of the vertical drive, during which the casting mold is unavoidably subject to vibrations, which can have a disadvantageous effect on the microstructure of the casting. The vertical drive has been retained primarily because, with it, it is possible achieve a very a high degree of precision with respect to the positioning of the casting mold carrier together with the casting mold in the pouring range of the melting furnace so that casting can be carried out effectively.

The experts, however, have already experimented with horizontally driven casting molds.

A precision casting system in which a support plate carrying a mold can be driven along a rollway and through a lock into an evacuated furnace chamber is known from DE-AS 10,60, 557. In this case, however, the casting mold must be positioned manually, because it is possible neither to position the casting mold precisely on the support plate nor to bring the support plate without further measures into a precise casting position. The known precision casting furnace is not suitable for automated series production, and it cannot be converted to such use without significant modifications to the transport system. In addition, the known precision casting furnace cannot be retrofitted with a device for bringing about oriented solidification. The invention proceeds from a precision casting system of this type.

A melting and casting system is known from U.S. Pat. No. 3,554,268, but this system is used for the refining of steel and for ingot casting, not for the production of precision castings. In the known device, a battery of ingot molds can be driven up by means of a first truck to a first lock door in a direction parallel to the door. The ingot molds rest on a second truck equipped with an electric motor and are driven over a series of rail segments into a casting chamber, which is separated from the furnace and melting chamber by a second lock gate. The rails of the first and second trucks extend at a right angle to each other. With the known device, it not possible to drive the ingot molds into the casting position. Instead, a transport ladle can be driven along upper rail segments, which are located above and parallel to the lower rail segments. These upper rail segments are divided into sections by the lock gates. Although the ladle itself can be brought into a casting position, it serves merely to transport the melt in portions to the individual ingot molds. Because the upper rail segments are interrupted at two points by the lock gates, a continuous railway must be produced by additional rail segments, which can be swung into position. The known system is not suitable for the production of precision castings and cannot be converted in such a way that a process of oriented solidification could be accomplished. Because of the extreme height of the ingot molds, this known system is two storeys tall even though there is no vertical drive present; that is, the furnace chamber is located on an elevated platform. The construction is in any case extremely complicated in this case as well.

U.S. Pat. No. 3,847,203 discloses stationary casting mold carrier which can be installed right in the furnace chamber of a precision casting system without lock devices. This carrier, including the casting mold, is surrounded by a heating chamber, which is suspended with the option of vertical movement for the purpose of oriented solidification. In this device, which should be described as a laboratory system, the problem of having to drive movable casting mold carriers with casting molds in the horizontal direction precisely into a casting position does not arise; the casting position is defined in advance by the stationary installation of the casting mold carrier. This system is also unsuitable for the automated production of large numbers of precision castings.

Summary of the Invention

The invention is therefore based on the task of providing a precision casting system of the general type described above, in which, at low construction cost, the casting mold carrier can be driven into the furnace chamber and can be brought with extreme precision into the predetermined casting position. So that this process can be better understood, it should be pointed out that the casting position is predetermined by the kinematic motion of the melting furnace and by the trajectory of the stream of molten metal as it is being poured. The kinematics of the casting process can be determined by experiment, calculation, adjustment, and simulation; once the pouring parameters are known, each of the casting molds must be brought with extreme positional accuracy into the proper casting position.

In accordance with the invention, the task thus imposed is accomplished in a precision casting system of the type described above in that the outer of the two sealing plates is mounted on a first truck, which can be driven along external rails, this truck carrying, on the other side of the sealing plate, a first internal rail segment for a second truck, on which the casting mold carrier is mounted; in that, between the first and the second truck, a horizontal drive for moving the second truck is provided; and in that, in the interior of the furnace chamber, a second internal rail segment is provided, to which the casting mold carrier can be transferred from the first internal rail segment and driven with high positional accuracy into the casting position.

The core of the invention, expressed in simplified terms, consists in that the first truck, the outer sealing plate of the lock, the first internal rail segment, and the second truck with the casting mold carrier represent a single structural unit, where the second truck can be driven with respect to the first internal rail section and the outer sealing plate by the horizontal drive and can thus be transferred to the second internal rail segment. Because the first truck, carrying the outer sealing plate and the casting mold, which can be at least partially preheated, is driven up to the outer valve seat of the lock chamber, the lock chamber is sealed off in a gas-tight manner without any further effort; the only measure remaining to be taken is to open the second, inner sealing plate of the lock and to transfer the second truck with the casting mold carrier and the casting mold to the second internal rail segment, which is precisely lined up with the first internal rail segment. Because the horizontal drive can be adjusted with great accuracy, it is now possible to move the casting mold up so that its axis is positioned precisely in the casting position and to pour the melt under the predetermined casting parameters. This process is absolutely reproducible and can be repeated as often as desired by means of an appropriately designed process control system.

The positioning is accomplished with extreme precision on two coordinates of a horizontal coordinate system, namely, first, through the layout of the internal rail segments and, second, by virtue of the predetermined displacement of the horizontal drive. Because all of these motions are executed on a horizontal plane, the entire precision casting system does not have to be very tall; in particular, there is no need for a pit, such as that described in DE-OS 32, 20, 744 described above. The entire precision casting system is easy to maintain and to operate, and in particular the components which are likely to get dirty are easy to clean. Specifically, the valve seats of the lock valves, the so-called sealing plates, are easy to keep clean. The outer sealing plate is guided automatically by the first truck; no additional guidance is required. The second, inner sealing plate also does not require any complicated support devices acting at right angles to its direction of motion, as would be required in the case of lock valves with a valve seat situated in a horizontal plane. In the case of the object of the invention, the second, inner valve seat is in a vertical plane.

As part of an additional embodiment of the invention, it is especially advantageous for the horizontal drive to have a hollow transport rod, which passes by means of a stuffing box through the outer sealing plate of the lock, and for at least one transmission line from the group consisting of coolant lines and temperature measurement lines to be installed in the hollow transport rod, this line being connected to the casting mold carrier. In this way, it is possible, throughout the entire time in which the casting mold is on the casting mold carrier, to maintain the casting mold carrier at a given temperature, a process which is especially important for ensuring the success of oriented solidification.

If, in the precision casting system according to the invention, an oriented solidification is to be carried out, it is especially advantageous as part of another embodiment of the invention for a heating chamber, which can be raised and lowered, to be installed in the furnace chamber above the casting position. The heating chamber is equipped with a filling hole and with heating elements and can be lowered over the casting mold and the casting mold carrier.

For reasons of thermal engineering, it is also advantageous for a spacer to be provided between the casting mold carrier, which is designed as a cooling plate, and the second truck, especially when the height of this spacer, at least one of which is provided, can be adjusted, so that is possible to bring about an additional orientation of the casting mold in the height direction. In this case, it is also especially advantageous for a heat shroud to extend downward from the edge of the mold carrier over at least part of the height of the spacer.

To minimize heat losses from the heating chamber, it is especially advantageous for a heat protection ring to be mounted at the lower end of the heating chamber; this ring extends radially inward toward the heat shroud and/or the casting mold, while leaving the narrowest possible ring-shaped gap.

If this heat protection ring is designed to be replaceable, it is possible to use casting molds and/or casting mold carriers of different diameters.

So that the heat distribution inside the heating chamber can be varied, it is also of particular advantage for the heat protection ring to rest loosely on an inside flange at the lower end of the heating chamber. Thus, when the heating chamber is lowered across the plane of the casting mold carrier, this heat protection ring can be lifted up from the flange by the carrier and moved in relative fashion into the heating chamber. This solution also makes it possible for casting molds of smaller but different diameters to rest on a larger casting mold carrier, because the heat protection ring always works together with the casting mold carrier as a radiation shield.

If oriented solidification is not to be conducted in the device according to the invention, it is possible to disconnect the transport rod from the second truck, as a result of which the inside sealing plate can also be closed during the melting and/or casting process. When oriented solidification is carried out, however, it is necessary to keep the transport rod connected to the second truck to maintain the connections for the coolant circuit and for the temperature measuring elements.

DETAILED DESCRIPTION OF THE PREFERRED EMBODIMENT

Figure 1:
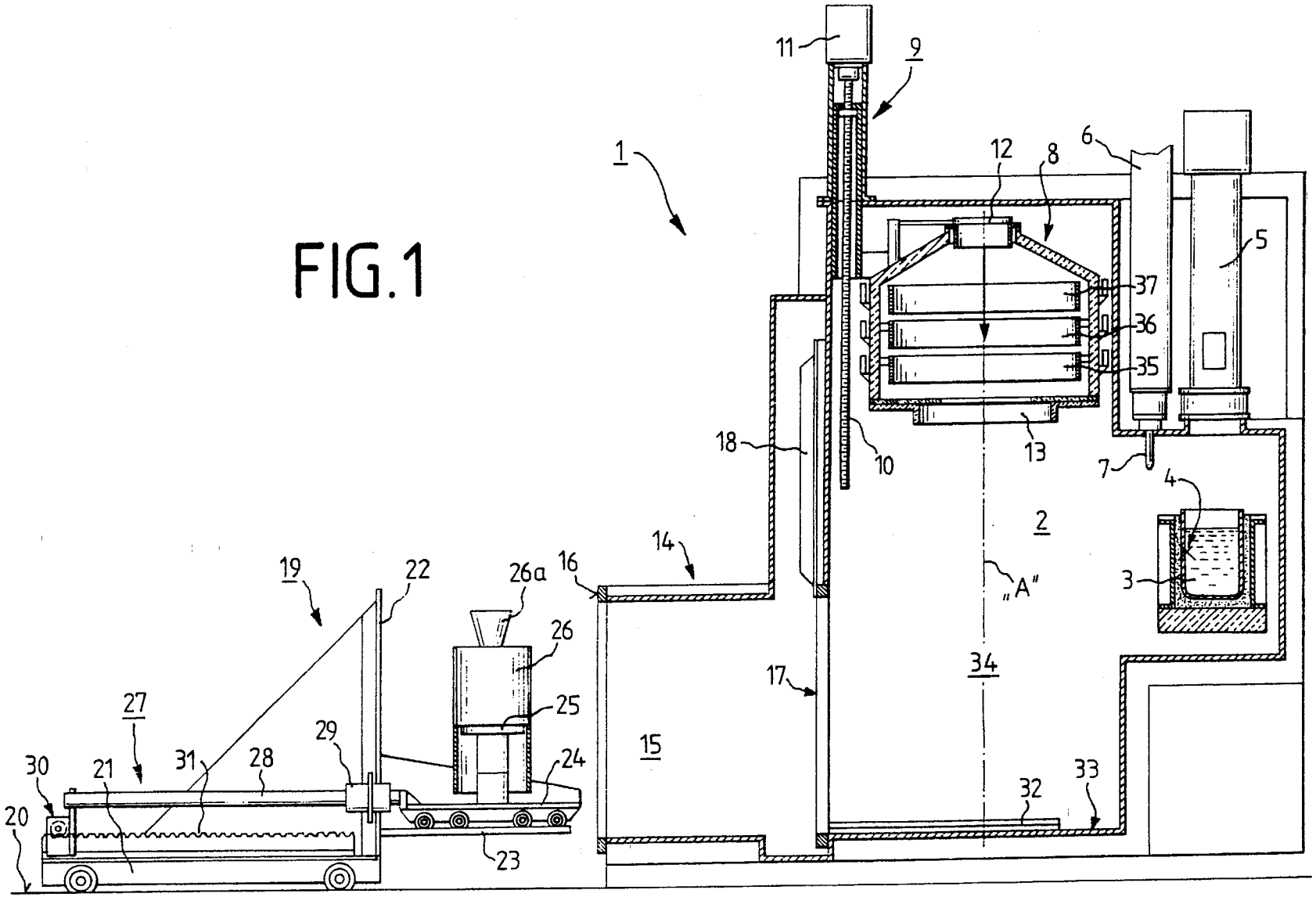
FIG. 1 shows a vertical cross section through a precision casting system before the introduction of the casting mold into the lock.

FIG. 1 shows a precision casting system 1, to which a gas-tight furnace chamber 2 belongs, in which a melting furnace 3 is installed. The furnace is designed as a vacuum induction furnace and can be tipped around a horizontal axis 4 to assume an emptying position. FIG. 1 shows the melting position. Above melting furnace 3 is a loading lock 5 for the material to be melted and a temperature measuring device 6 with a probe 7, which can be lowered to measure the temperature of the melt.

In furnace chamber 2, furthermore, there is an essentially rotationally symmetric heating chamber 8, which can be raised and lowered by means of a vertical drive 9, which consists of a threaded spindle 10 and a spindle motor 11. Spindle motor 11 is designed in such a way that it can move heating chamber 8 both at a fast speed and also at a slow speed. Heating chamber 8 has at its upper end a filling hole 12 and at its lower end an opening 13 for a casting mold and a casting mold carrier, which is explained in more detail on the basis of the figures.

On the side opposite melting furnace 3, furnace chamber 2 is provided with a lock 14, which has a lock chamber 15 with an outer valve seat 16 and an inner valve seat 17. An inner sealing plate 18 cooperates with inner valve seat 17; the vertical drive of this plate is not shown here, because it belongs to the state of the art. Furnace chamber 2 is connected by way of a vacuum line, not shown either, to a vacuum pump unit.

In front of the (opened) lock chamber 15 there is a transport unit 19, to which a first truck 21, which runs on external rails 20, belongs. Another sealing plate 22 is attached to this truck. By the movement of truck 21, this plate can be made to form a hermetic seal against external valve seat 16. 0n the other side of sealing plate 22 there is a first internal rail segment 23, supported in a cantilevered manner, on which a second truck 24 with a casting mold carrier 25 and a casting mold 26 is supported. The casting mold has a filling funnel 26*a*. Second truck 24 is connected to first truck 21 by a horizontal drive 27. Horizontal drive 27 includes a hollow transport rod 28, which passes by way of a stuffing box 29 through outer sealing plate 22. The other end of transport rod 28 is connected to a drive unit 30, which engages in a horizontal toothed rack 31 on the first truck. The first internal rail segment 23 is aligned with a second internal rail segment 32, which is attached on the other side of valve seat 17 to floor 33 of furnace chamber 2. This second rail segment is in the area of a casting position 34, which is indicated by axis A.

As soon as transport unit 19 is driven toward the right from the position shown in FIG. 1, so that sealing plate 22 rests in a gas-tight manner against valve seat 16, rail segment 23 is located together with second truck 24, casting mold carrier 25, and casting mold 26 in the interior of lock chamber 15. This chamber can now be evacuated, whereupon sealing plate 18, which has been closed up to now, is raised into the position shown in FIG. 1. At this point, second truck 24 with all that it is carrying is transferred from rail segment 23 to rail segment 32, by actuation of horizontal drive 27. The end position thus reached is illustrated in FIG. 2.

Figure 2:
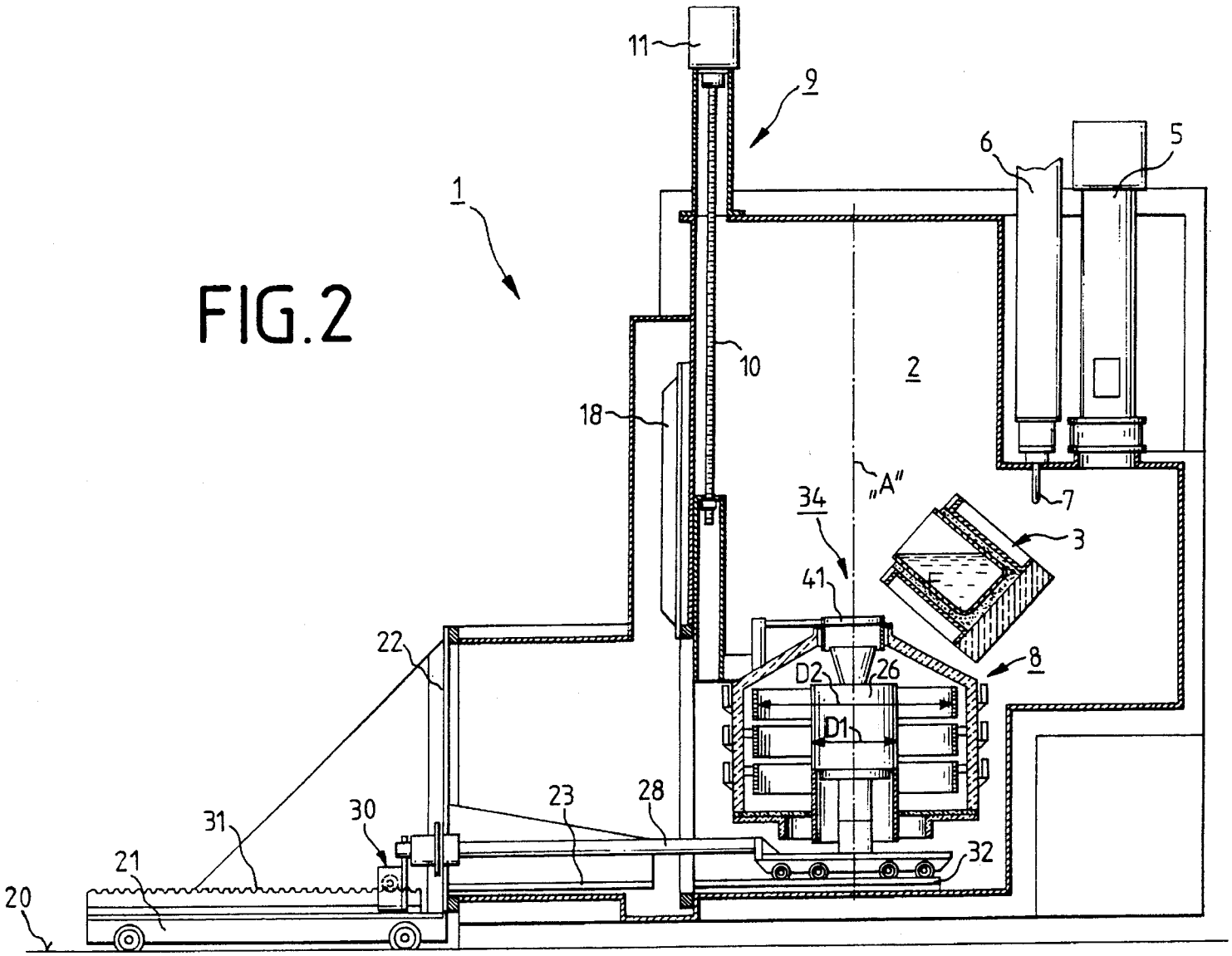
FIG. 2 shows a vertical cross section through the precision casting system according to FIG. 1, but after the casting mold has been driven into the casting position directly in front of the spout of the melting furnace.
Figure 3:
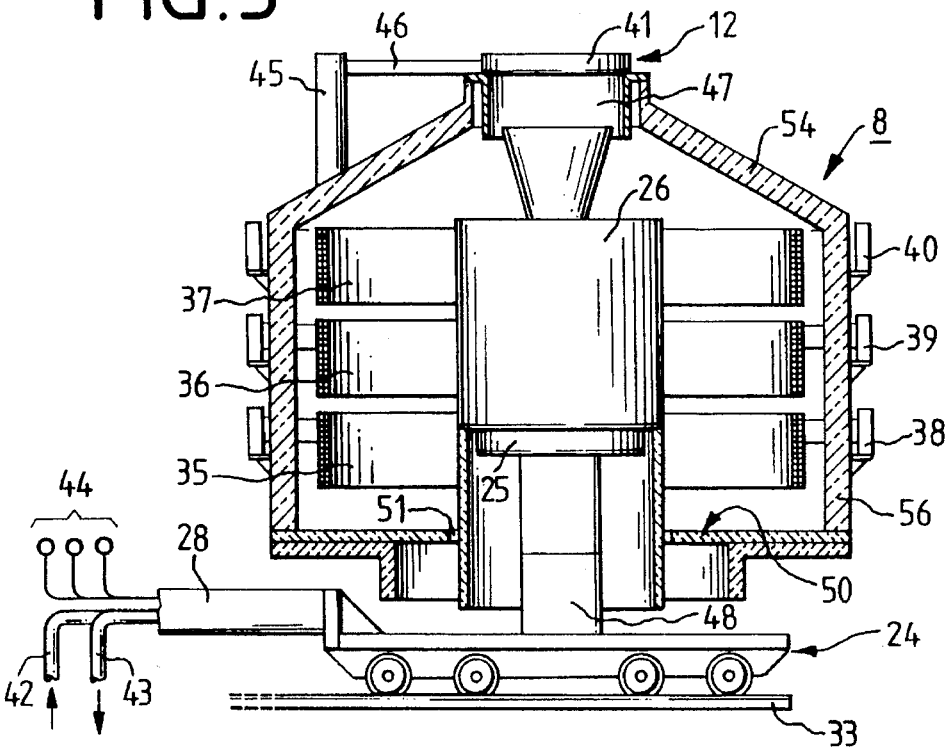
FIG. 3 shows part of the area of the heating chamber of FIG. 2 on an enlarged scale, with additional details, immediately after the melt has been poured from the furnace.

In the position illustrated in FIG. 2, drive unit 30 has moved to the right on rack 31, as a result of which transport rod 28 has been pushed far enough to the right to bring truck 24 into casting position 34 as defined by axis "A". In this position, the axis of casting mold 26 is aligned precisely with the axis of the casting position. Once casting mold carrier 25 and casting mold 26 have assumed the proper position, heating chamber 8 is moved down into its lowermost position by vertical drive 9, as shown in FIG. 2. In this position, casting mold 26 is first heated by three heating elements 35, 36, 37, which are supplied with heating power through power feeds 38, 39, 40 (FIG. 3). Diameters D1 and D2 shown in FIG. 2 are intended to demonstrate the most essential dimensions. For example, diameter D1 of the casting mold is, for example, about 86 cm, while the inside diameter D2 of heating elements 35–37 is about 127 cm. Casting mold 26, in comparison to purely laboratory systems, is quite large in any case.

FIG. 2.shows that heating chamber 8, in the area of filling hole 12, is still closed by an insulation plate 41, which is swung out of the way immediately before casting. Melting furnace 3 has already reached its pouring position by rotation around axis 4. After insulation plate 41 has been swung out of the way, uninterrupted casting can be carried-out directly from the position of melting furnace 3 shown in FIG. 2.

Figure 4:
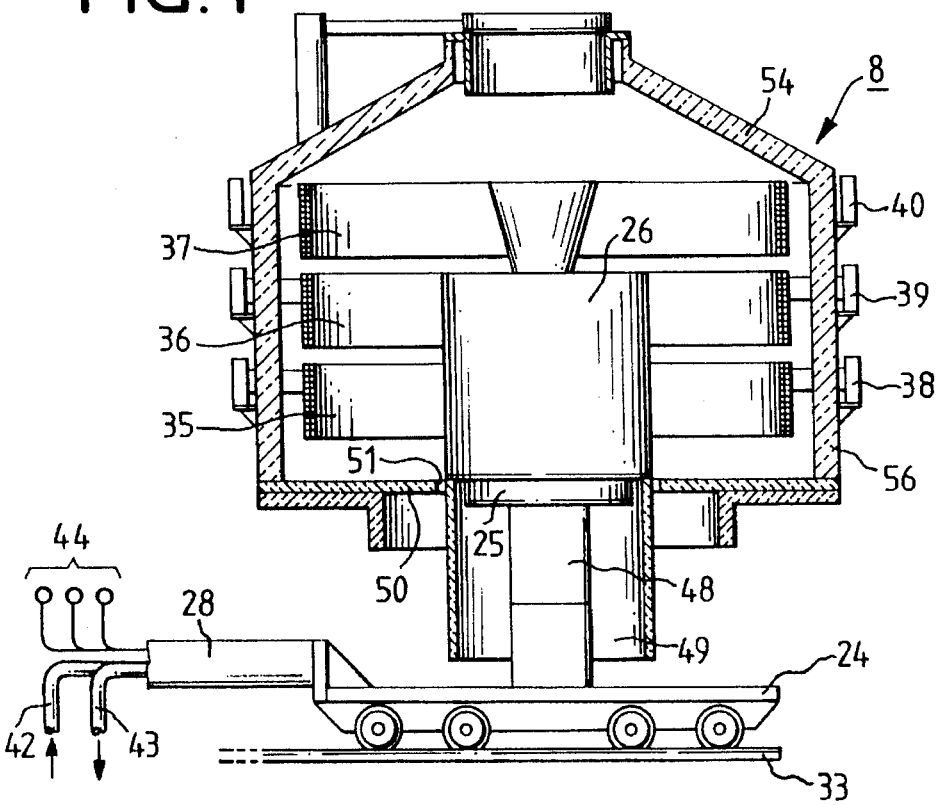
FIG. 4 shows a diagram similar to that of FIG. 3, but after the heating chamber has been raised to the point at which oriented solidification just begins.
Figure 5:
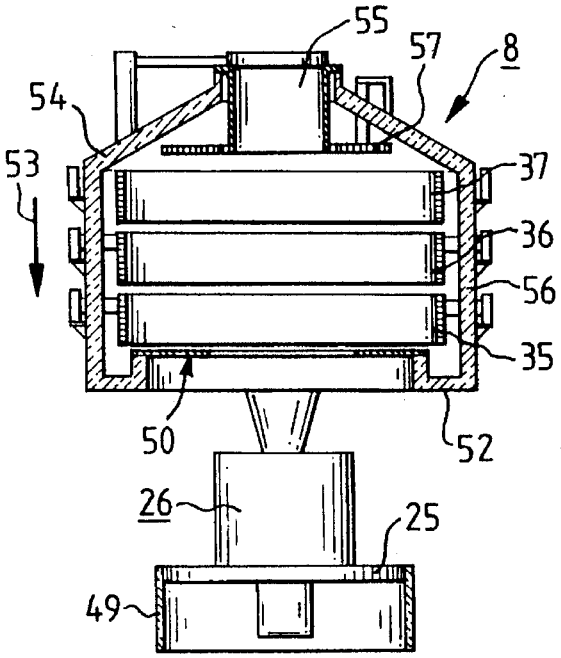
FIGS. 5–8 show different relative positions of the heating chamber with respect to another casting mold with its mold carrier in conjunction with the use of a movable heat protection ring.

In FIGS. 3 and 4, additional details in the area of heating chamber 8 are shown. First, it is shown that two coolant lines 42, 43 pass through transport rod 28 and are connected to casting mold carrier 25, which is designed as a cooling plate, by internal connecting lines, only partially indicated. In similar fashion, a group of measurement lines 44 also passes through transport rod 28, by means of which the various temperature changes in the area of the casting mold carrier and the casting mold can be detected. Because the location of the individual measurement sites in such processes is state of the art, no further details are given here.

FIG. 3 shows heating chamber 8 in the position just before casting begins. At this point, filling hole 12 is still sealed by insulation plate 41 already described above, which can be swung out of the way by means of a pivot drive 45, operating a lever 46. To prevent any splashes of molten metal from contaminating the inside of heating chamber 8, a splash-protection ring 47 is also installed in filling hole 12.

Between casting mold carrier 25 and second truck 24, there is also a spacer 48, which can be replaced by one or more hydraulic cylinders, so that the distance between casting mold carrier 25 and truck 24 can be adjusted. The necessary hydraulic lines in this case also pass through transport rod 28, but this is not shown here. To prevent heat from leaving heating chamber 8 in the downward direction and simultaneously to protect spacer 48 from excessive heat, a heat protection shroud 49 extends downward from the edge of mold carrier 25 to just above truck 24. Heat shroud 49 also surrounds casting mold 26. In the same way, it is also possible to provide a heat protection ring 50, which extends radially inward toward heat shroud 49 (FIG. 3) or to casting mold 26 (FIG. 4), at the lower end of heating chamber 8, while leaving the narrowest possible ring-shaped gap 51. When heating chamber 8 is raised from the casting position shown in FIG. 3 at the beginning of oriented solidification according to FIG. 4 and then moved further upward, the width of ring-shaped gap 51 remains preserved over the length of heat shroud 49 and over the length of casting mold 26.

When casting molds 26 with different diameters are used, heat protection ring 50 can be removed and replaced by one with the proper inside diameter.

FIGS. 5–8 show an improved possibility for preventing heat losses from heating chamber 8 in the downward direction. In this case, heat protection ring 50 is laid loosely on an internal flange 52, which is located at the bottom end of heating chamber 8. When heating chamber 8 is lowered in the direction of arrow 53 into the heating position according to FIG. 6, that is, across the plane of casting mold carrier 25, heat protection ring 50 is picked up by casting mold carrier 25.

Figure 7:
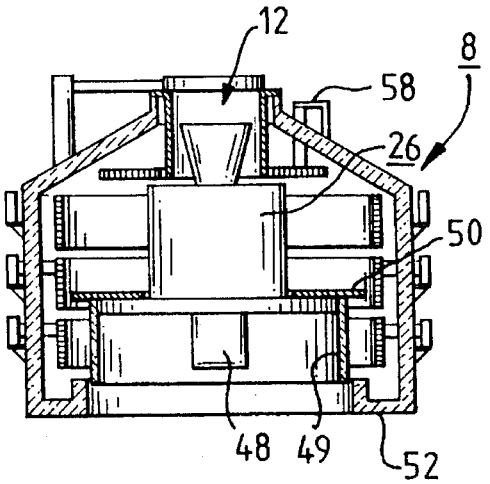
Figure 6:
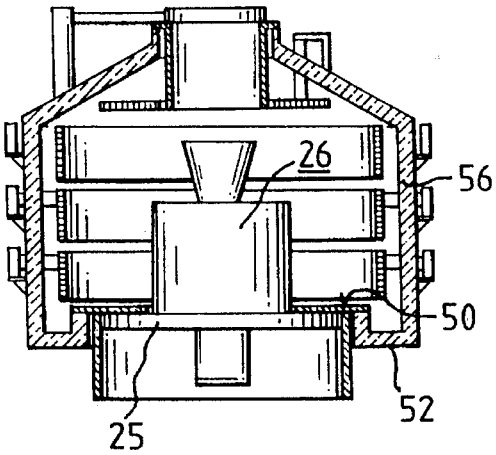

As heating chamber 8 is lowered even further, i.e., from the heating position shown in FIG. 6, to-the point that it reaches the position for casting according to FIG. 7, heat protection ring 50 is lifted from internal flange 52 and, seen in relative terms, moved up and into heating chamber 8. Because of the presence of heat shroud 49, spacer 48 is protected in this case, too, from unacceptably intense thermal radiation. But it is also possible to turn off the two lower heating elements 35, 36 in the position according to FIG. 7, but this will probably be meaningful only if the thermal inertia of these heating elements is low.

Figure 8:
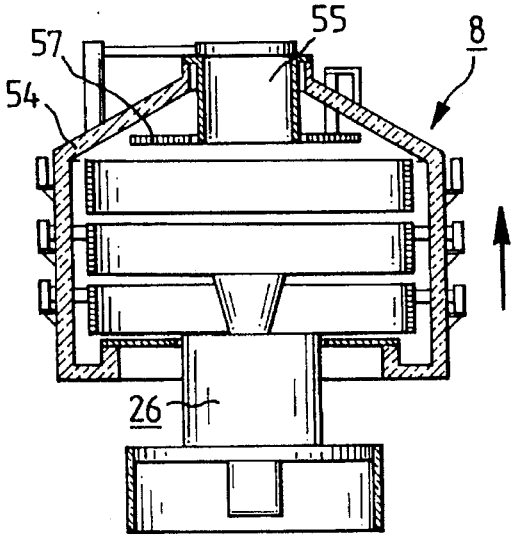

FIG. 8, finally, shows the relative position of casting mold 26 and heating chamber 8 with respect to each other at the end of oriented solidification. The crystallization front, which moves continuously from the bottom toward the top, has arrived at the upper end of casting mold 26. From the position according to FIG. 6, heating chamber 8 is moved at slow speed into the position according to FIG. 8 in correspondence with the speed of the crystallization front.

As FIGS. 3 and 4 also show, a heat insulation cover 54, designed as a rotationally symmetric body which surrounds filling hole 12, is provided at the upper end of heating chamber 8. This cover 54 is also present in the case of heating chamber 8 according to FIGS. 5–8, where it is provided with a ring 55 surrounding filling hole 12; this ring projects downward into heating chamber 8. In the space between this ring 55 and cover 54 there is also another ring-shaped, flat heating body 57, which is supplied with heating power by way of terminals 58.

We claim:

1. Precision casting system comprising a furnace chamber, a lock comprising an outer opening, an inner opening providing access to said furnace chamber, and an inner sealing plate movable over said inner opening, a first truck having fixed thereto an outer sealing plate and a first rail segment, said first rail segment being moved into said lock when said outer sealing plate is moved into closing engagement with said outer opening, a second truck carrying a casting mold carrier and movably mounted on said first rail segment, a second rail segment inside said furnace chamber, and drive means for driving said second truck from said first rail segment to a casting position on said second rail segment when said first truck brings said outer sealing plate into closing engagement with said outer opening.

2. Precision casting system as in claim 1 wherein said drive means comprises a stuffing box in said outer sealing plate, a hollow transport rod fixed to said second truck and movable with respect to said first truck through said stuffing box, and transmission means passing through said hollow rod and connected to said casting mold carrier, said transmission means comprising at least one of coolant lines and temperature measuring lines.

3. Precision casting system as in claim 1 further comprising a heating chamber which is vertically movable over said casting position in said furnace chamber for reception about a casting mold on said casting mold carrier, said heating chamber having a filling hole for receiving molten metal.

4. Precision casting system as in claim 3 further comprising an insulation plate movable into sealing engagement with said filling hole.

5. Precision casting system as in claim 3 further comprising a tubular splash ring received concentrically in said filling hole.

6. Precision casting system as in claim 3 wherein said casting mold carrier comprises cooling means for a casting mold, said system further comprising a vertical drive for moving said heating chamber vertically.

7. Precision casting apparatus as in claim 3 wherein said heating chamber comprises a cylindrical wall, a rotationally symmetric insulating cover supported on said cylindrical wall, a tubular ring supported by said cover and surrounding said filling hole, and a ring shaped heating body surrounding said tubular ring.

8. Precision casting system as in claim 1 further comprising spacer means between said casting mold carrier and said second truck.

9. Precision casting system as in claim 8 wherein said spacer means comprising means of adjusting height.

10. Precision casting system as in claim 8 further comprising a heat protection shroud extending downward from the casting mold carrier and around the spacer means.

11. Precision casting apparatus as in claim 10 further comprising a heat protection ring which extends radially inward from said heat protection shroud toward said mold.

12. Precision casting apparatus as in claim 11 wherein said heat protection ring is removable.

13. Precision casting apparatus as in claim 12 wherein said heating chamber comprises an inside flange on which said heat protection ring rests loosely, said ring being picked up by said casting mold carrier when said heating chamber moves vertically downward.

* * * * *